US010879592B2

(12) United States Patent
Ying et al.

(10) Patent No.: US 10,879,592 B2
(45) Date of Patent: Dec. 29, 2020

(54) VERTICAL ANTENNA PATCH IN CAVITY REGION

(71) Applicant: Sony Mobile Communications, Inc., Tokyo (JP)

(72) Inventors: Zhinong Ying, Lund (SE); Kun Zhao, Stockholm (SE)

(73) Assignee: Sony Mobile Communications Inc., Tokyo (JP)

( * ) Notice: Subject to any disclaimer, the term of this patent is extended or adjusted under 35 U.S.C. 154(b) by 0 days.

(21) Appl. No.: 16/464,094

(22) PCT Filed: Nov. 25, 2016

(86) PCT No.: PCT/EP2016/078829
§ 371 (c)(1),
(2) Date: May 24, 2019

(87) PCT Pub. No.: WO2018/095535
PCT Pub. Date: May 31, 2018

(65) Prior Publication Data

US 2019/0288377 A1 Sep. 19, 2019

(51) Int. Cl.
*H01Q 1/38* (2006.01)
*H01Q 21/06* (2006.01)
(Continued)

(52) U.S. Cl.
CPC ..... *H01Q 1/243* (2013.01); *H01Q 1/38* (2013.01); *H01Q 9/0407* (2013.01);
(Continued)

(58) Field of Classification Search
CPC ..... H01Q 9/04; H01Q 9/0407; H01Q 9/0414; H01Q 9/045; H01Q 21/06; H01Q 21/061;
(Continued)

(56) References Cited

U.S. PATENT DOCUMENTS 5,770,981 A 6/1998 Koizumi et al.
5,955,752 A 9/1999 Fukaya et al.
(Continued)

FOREIGN PATENT DOCUMENTS

JP 08274513 A 10/1996
JP 2002171119 A 6/2002
WO 2016/052733 A1 4/2016

OTHER PUBLICATIONS

International Search Report and Written Opinion for corresponding Patent Application No. PCT/EP2016/078829 dated Sep. 9, 2017.
(Continued)

*Primary Examiner* — Jason Crawford
(74) *Attorney, Agent, or Firm* — Renner, Otto, Boisselle & Sklar, LLP

(57) ABSTRACT

A multi-layer circuit structure (110) has multiple layers stacked along a vertical direction. Further, at least one cavity region (120) is formed at an edge of the multi-layer circuit structure (110). The at least one cavity region (120) is formed of multiple non-conductive vias from which a dielectric substrate material of the multi-layer circuit structure (120) is removed. Further, the device comprises at least one vertical antenna patch (130) arranged in the at least one cavity region (120).

20 Claims, 10 Drawing Sheets

(51) Int. Cl.

| | |
|---|---|
| ***H01Q 1/24*** | (2006.01) |
| ***H01Q 9/04*** | (2006.01) |
| ***H01Q 19/06*** | (2006.01) |
| ***H01Q 21/00*** | (2006.01) |
| *H01Q 25/00* | (2006.01) |
| *H01Q 21/08* | (2006.01) |
| *H01Q 15/10* | (2006.01) |

(52) U.S. Cl.
CPC ..... *H01Q 9/0414* (2013.01); *H01Q 9/0457* (2013.01); *H01Q 19/06* (2013.01); *H01Q 21/0093* (2013.01); *H01Q 21/067* (2013.01); *H01Q 15/10* (2013.01); *H01Q 21/08* (2013.01); *H01Q 25/001* (2013.01)

(58) Field of Classification Search
CPC .... H01Q 21/065; H01Q 21/068; H01Q 21/08; H01Q 5/378; H01Q 5/385; H01Q 5/392; H01Q 19/005; H01Q 1/2283
See application file for complete search history.

(56) References Cited

U.S. PATENT DOCUMENTS

| | | | | |
|---|---|---|---|---|
| 6,943,735 | B1 | 9/2005 | Cadotte, Jr. | |
| 2002/0041254 | A1 | 4/2002 | Nakano et al. | |
| 2006/0238420 | A1 | 10/2006 | Jansen | |
| 2011/0057853 | A1* | 3/2011 | Kim | H01Q 1/48 343/843 |
| 2011/0248891 | A1* | 10/2011 | Han | H01Q 9/0485 343/700 MS |
| 2011/0248895 | A1 | 10/2011 | Bungo et al. | |
| 2012/0249388 | A1 | 10/2012 | Hansen et al. | |
| 2012/0256796 | A1* | 10/2012 | Leiba | H01Q 1/2283 343/702 |
| 2013/0207869 | A1 | 8/2013 | Han et al. | |
| 2013/0257672 | A1* | 10/2013 | Lu | H01Q 1/525 343/843 |
| 2015/0318618 | A1* | 11/2015 | Chen | H01Q 21/005 343/750 |
| 2016/0043470 | A1 | 2/2016 | Ko et al. | |
| 2016/0211586 | A1 | 7/2016 | Hong et al. | |
| 2016/0365638 | A1* | 12/2016 | Luk | H01Q 9/285 |
| 2018/0026378 | A1* | 1/2018 | Hadavy | H01Q 21/064 343/771 |
| 2019/0305429 | A1* | 10/2019 | Ying | H01Q 9/045 |

OTHER PUBLICATIONS

Navarro EA et al: "Synthetic dielectrics for planar antenna design", Electronics LET, IEE Stevenage, GB, vol. 36, No. 6, Mar. 16, 2000 (Mar. 16, 2000), pp. 491-493, XP006014972, ISSN: 0013-5194, DOI: 10.1049/EL:20000413 Section: Introduction; figure 1.

Japanese Office Action and translation for corresponding Japanese Patent Application No. 2019-528100 dated Sep. 8, 2020.

* cited by examiner

VERTICAL ANTENNA PATCH IN CAVITY REGION

RELATED APPLICATIONS

This application is a national phase entry of International Application No. PCT/EP2016/078829 filed on Nov. 25, 2016 and published in the English language, which is hereby incorporated by reference in its entirety.

FIELD OF THE INVENTION

The present invention relates to antenna devices and to communication devices equipped with one or more of such antenna devices.

BACKGROUND OF THE INVENTION

In wireless communication technologies, various frequency bands are utilized for conveying communication signals. In order to meet increasing bandwidth demands, also frequency bands in the millimeter wavelength range, corresponding to frequencies in the range of about 10 GHz to about 100 GHz, are considered. For example, frequency bands in the millimeter wavelength range are considered as candidates for 5G ($5^{th}$ Generation) cellular radio technologies. However, an issue which arises with the utilization of such high frequencies is that antenna sizes need to be sufficiently small to match the wavelength. Further, in order to achieve sufficient performance, multiple antennas (e.g., in the form of an antenna array) may be needed in small sized communication devices, such as mobile phones, smartphones, or similar communication devices.

Further, since losses on cables or other wired connections within the communication device typically increase towards higher frequencies, it may also be desirable to have an antenna design in which the antenna can be placed very close to radio front end circuitry.

Accordingly, there is a need for compact size antennas which can be efficiently integrated in a communication device.

SUMMARY OF THE INVENTION

According to an embodiment, a device is provided. The device comprises a multi-layer circuit structure having multiple layers stacked along a vertical direction. Further, the device comprises at least one cavity region formed at an edge of the multi-layer circuit structure. The at least one cavity region is formed of multiple non-conductive vias from which a dielectric substrate material of the multi-layer circuit structure is removed. Further, the device comprises at least one vertical antenna patch arranged in the at least one cavity region. This is in particular beneficial in the case of substrate materials having a high dielectric constant, such as ceramic based materials. In some scenarios, the dielectric constant of the substrate material may be more than 3, e.g., in the range of 3 to 20, typically in the range of 5 to 8. By the cavity region, adverse influences of the substrate material on the transmission characteristics of the antenna patch, e.g., by attenuating or distorting radio signals, can be avoided. Further, the cavity region may allow for reducing propagation of surface waves along the edge of the multi-layer circuit structure.

By using the non-conductive vias to form the cavity region, the overall density of the substrate material is reduced in the cavity region, resulting in a lower effective dielectric constant. Since the cavity region does not need to be formed as a contiguous void within the multi-layer circuit structure, remaining substrate material may carry the at least one antenna patch, which thus may be efficiently integrated within the cavity region, e.g., by forming the at least one antenna patch form conductive strips and conductive vias connecting the conductive strips.

According to an embodiment, the non-conductive vias of the cavity region are arranged to form a mesh grid of the substrate material in the cavity region. For example, the non-conductive vias could be arranged according to a one-dimensional, two-dimensional, or three-dimensional lattice, to form pores or voids within the substrate material. In this way, the density of the substrate material may be efficiently reduced in the cavity region, while at the same time maintaining a good stability of the remaining substrate material which carries the at least one antenna patch. According to an embodiment, the non-conductive vias of the cavity region are filled with a dielectric material having a lower dielectric constant than the substrate material of the multi-layer circuit structure. For example, if the substrate material is a ceramic material, the dielectric material for filling the non-conductive vias may be a resin. In some scenarios, the non-conductive vias could also be filled with air.

According to an embodiment, the substrate material of the multi-layer circuit structure comprises a ceramic material. The substrate material may also comprise of a combination of one or more ceramic materials with one or more other materials, e.g., a combination of a ceramic material and a glass material. When using these kinds of materials, the substrate material may have a high dielectric constant, which helps to provide signal connections within the multi-layer circuit structure with favorable transmission characteristics for high-frequency signals in the range of about 10 GHz to about 100 GHz. The layers of the multi-layer circuit structure may be assembled by low temperature co-firing. Accordingly, the multi-layer circuit structure may be an LTCC (low-temperature co-fired ceramic). However, other technologies for forming the multi-layer circuit structure could be used as well. For example, the multi-layer circuit structure could be a printed circuit board (PCB).

According to an embodiment, the cavity region comprises at least one first conductive strip formed in one or more of the multiple layers and defining a first horizontal edge of the cavity region, at least one second conductive strip formed in one or more of the multiple layers and defining a second horizontal edge of the cavity region, and conductive vias extending between the at least one first conductive strip and the at least one second conductive strip and defining vertical outer edges of the cavity region. In this way, a conductive shielding may be formed along the edges of the cavity region. This may for example help in further reducing propagation of surface waves along the edge of the multi-layer circuit structure.

According to an embodiment, the vertical antenna patch is formed of multiple conductive strips formed in one or more of the multiple layers, and these conductive strips of the vertical antenna patch are electrically connected to each other by conductive vias extending between two or more of the conductive strips which are arranged on different layers of the multi-layer circuit structure. For example, the conductive strips and the conductive vias of the vertical antenna patch could be arranged to form a mesh pattern, e.g., in the form of a regular grid extending in a plane defined by the horizontal direction and the vertical direction. In this way, the vertical antenna patch may be efficiently integrated within the multi-layer circuit structure. However, other ways for forming the vertical antenna patch could be used as well, e.g., by forming the antenna patch as a vertical conductive strip on the edge of the multi-layer circuit structure.

The at least one antenna patch may be configured for transmission of radio signals having a wavelength of more than 1 mm and less than 3 cm, corresponding to frequencies of the radio signals in the range of 10 GHz to 300 GHz. The at least one antenna patch may be configured for transmission of radio signals having a horizontal polarization, i.e., a linear polarization along the horizontal direction. Further, the at least one antenna patch may be configured for transmission of radio signals having a vertical polarization, i.e., a linear polarization along the vertical direction. In some embodiments, the device may also provide mixed configurations in which one or more of the antenna patches are configured for transmission of radio signals having a horizontal polarization and one or more of the antenna patches are configured for transmission of radio signals having a vertical polarization.

According to an embodiment, the device comprises at least one electrically floating patch capacitively coupled to the at least one antenna patch, i.e., a conductive patch which is merely capacitively coupled to the antenna patch and not conductively coupled to ground or some other fixed potential. The electrically floating patch is arranged in a plane offset from the at least one antenna patch in a direction towards a periphery of the multi-layer circuit structure. By introducing the electrically floating patch, a useful bandwidth of radio signals transmitted by the antenna patch can be increased as compared to a configuration without the electrically floating patch. By choosing the size of the electrically floating patch and/or the distance between the antenna patch and the electrically floating patch, the bandwidth can be tuned to a desired range.

According to an embodiment, the electrically floating patch is formed of multiple conductive strips in one or more of the multiple layers, and the conductive strips of the electrically floating patch are electrically connected to each other by conductive vias extending between two or more of the conductive strips of the electrically floating patch, which are arranged on different layers of the multi-layer circuit structure. For example, the conductive strips and the conductive vias of the electrically floating patch could be arranged to form a mesh pattern, e.g., in the form of a regular grid extending in a plane defined by the horizontal direction and the vertical direction. In this way, the electrically floating patch may be efficiently integrated within the multi-layer circuit structure. However, other ways for forming the vertical antenna patch could be used as well, e.g., by forming the antenna patch as a vertical conductive strip on the edge of the multi-layer circuit structure.

Alternatively, the electrically floating patch could be formed by a vertical conductive strip formed on a casing element in which the multi-layer circuit structure is arranged. This may allow for providing simplified overall assemblies. For example, in scenarios where a rather large distance between the electrically floating patch and the antenna patch is desired, this allows for providing the electrically floating patch without requiring to increase the overall size of the multi-layer circuit structure. Moreover, forming the electrically floating patch on the casing element allows for separating the antenna patch and the electrically floating patch by an air gap, which may help to avoid distortion or damping of the transmitted radio signals. The casing element could be a frame formed around a periphery of the multi-layer circuit structure. Further, the casing element could be a part of a housing of a communication device in which the device is arranged.

According to an embodiment, the device comprises a casing element in which the multi-layer circuit structure is arranged and at least one dielectric patch arranged on the casing element in a plane facing the at least one antenna patch. The dielectric patch is configured with a variation pattern of dielectric constant. In this way, the dielectric patch may be used to compensate for distortion of radio signals transmitted from the antenna patch. Such distortion may be caused by a dielectric material of the casing element and typically results in divergence of the radio signals after passing through the casing element. By the variation pattern, the dielectric patch may be configured to act as a converging lens for the radio signals, thereby compensating the divergence introduced by the casing element. This can for example be achieved by configuring the variation pattern to define an increase of dielectric constant towards a center of the dielectric patch.

According to an embodiment, the at least one dielectric patch comprises non-conductive vias from which a dielectric substrate material of the dielectric patch is removed. The variation pattern may then be configured in an efficient manner by setting a density of non-conductive vias of the dielectric patch and/or by setting a size of the non-conductive vias of the dielectric patch.

According to an embodiment, the device comprises at least one feeding patch arranged in the at least one cavity region and configured for capacitive feeding of the at least one antenna patch. The feeding patch is formed of multiple conductive strips in one or more of the multiple layer. The conductive strips of the feeding patch being electrically connected to each other by conductive vias extending between two or more of the conductive strips of the feeding patch, which are arranged on different layers of the multi-layer circuit structure. For example, the conductive strips and the conductive vias of the electrically floating patch could be arranged to form a mesh pattern, e.g., in the form of a regular grid extending in a plane defined by the horizontal direction and the vertical direction. In this way, the electrically floating patch may be efficiently integrated within the multi-layer circuit structure.

However, it is noted that other ways of feeding the antenna patch could be utilized as well, e.g., conductive feeding or a combination of capacitive and conductive feeding.

According to an embodiment, the device comprises radio front end circuitry arranged on the multi-layer circuit structure. In this case, the multi-layer circuit structure may comprise a cavity in which the radio front end circuitry is received. In this way, losses occurring when transferring radio signals from the radio front end circuitry to the antenna patch may be reduced. If the device includes radio front end circuitry arranged on the multi-layer circuit structure, the multi-layer circuit structure may comprise a cavity in which the radio front end circuitry is received. This may allow for obtaining a compact overall package of the multi-layer circuit structure and the radio front end circuitry. Further, the transfer of radio signals from the radio front end circuitry to the antenna patch may be further optimized by shortening signal paths.

According to a further embodiment, a communication device is provided, e.g., in the form of a mobile phone, smartphone or similar user device. The communication device comprises a device according to any one of the above embodiments. Further, the communication device comprises at least one processor configured to process communication signals transmitted via the at least one antenna patch of the device.

The above and further embodiments of the invention will now be described in more detail with reference to the accompanying drawings.

DETAILED DESCRIPTION OF EMBODIMENTS

Figure 1:
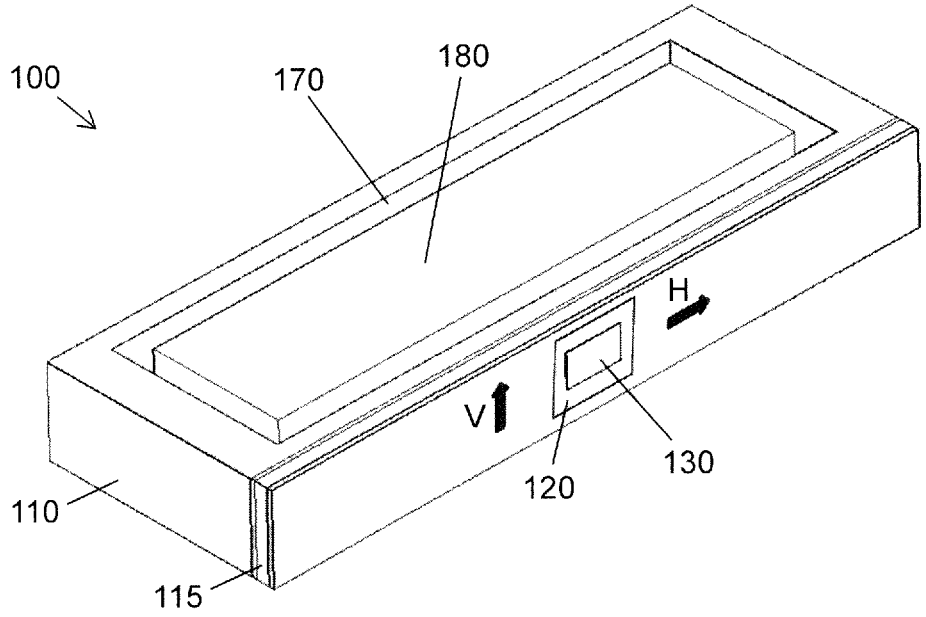
FIG. 1 shows a perspective view schematically illustrating an antenna device according to an embodiment of the invention.

In the following, exemplary embodiments of the invention will be described in more detail. It has to be understood that the following description is given only for the purpose of illustrating the principles of the invention and is not to be taken in a limiting sense. Rather, the scope of the invention is defined only by the appended claims and is not intended to be limited by the exemplary embodiments described hereinafter.

The illustrated embodiments relate to antennas for transmission of radio signals, in particular of short wavelength radio signals in the cm/mm wavelength range. The illustrated antennas and antenna devices may for example be utilized in communication devices, such as a mobile phone, smartphone, tablet computer, or the like.

In the illustrated concepts, a multi-layer circuit structure is utilized for forming a patch antenna. The multi-layer circuit structure has multiple layers stacked in a vertical direction. The layers of the multi-layer circuit structure may be individually structured with patterns of conductive strips. Further, conductive strips formed on different layers of the multi-layer circuit structure may be connected to each other by conductive vias extending between the conductive strips of different layers. The conductive strips may be formed by metallic layers on the dielectric substrate material of the layers. The conductive vias may correspond to punched, edged, or drilled holes which are at least partially filled with a conductive material, e.g., a metal.

By connecting conductive strips on different layers, three-dimensional conductive structures may be formed in the multi-layer circuit structure. As further explained below, such three-dimensional conductive structures may include one or more vertical antenna patches, one or more feeding patches, one or more electrically floating patches, and/or one or more conductive shields.

A vertical antenna patch as used in the illustrated embodiments is formed to extend in the vertical direction, perpendicular to the planes of the layers of the multi-layer circuit structure, thereby allowing a compact vertical antenna design. In this way, an antenna allowing for transmission of radio signals polarized in the vertical direction may be formed in an efficient manner. Further, one or more layers of the multi-layer circuit board may be utilized in an efficient manner for connecting the patch antenna to radio front end circuitry. Specifically, a small size of the patch antenna and short lengths of connections to the patch antenna may be achieved. Further, it is possible to integrate a plurality of such vertical antenna patches in the multi-layer circuit structure. Moreover, the vertical antenna patches may also be utilized for transmission of radio signals polarized in a horizontal direction, extending in parallel to the planes of the layers of the multi-layer circuit structure. Further, also dual-polarization configurations are possible, supporting both the transmission of radio signals polarized in the vertical direction, and transmission of radio signals polarized in a horizontal direction. Accordingly, different polarization directions may be supported in a compact structure.

In the embodiments as further detailed below, it will be assumed that the multi-layer circuit structure is an LTCC. However, it is noted that other technologies could be used as an alternative or in addition to the LTCC technology. For example, the multi-layer circuit structure could be formed as a PCB, based on structured metal layers printed on resin and fiber based substrate layers, or as a combination of an LTCC and PCB. Further, the multi-layer circuit structure could use layers which are based on a combination of a ceramic material and a non-ceramic material, e.g., a combination of a ceramic material and a glass material and/or resin. The technology and materials used to form the multi-layer circuit structure may also be chosen in view of desirable dielectric properties for supporting transmission of radio signals of a certain wavelength, e.g., based on the relation $$L = \frac{\lambda}{2\sqrt{\varepsilon_r}}, \quad (1)$$

where L denotes an effective dimension of the antenna patch, λ denotes the wavelength of the radio signals to be transmitted, and $\varepsilon_r$ denotes the relative permittivity of the substrate material of the multi-layer circuit structure. In typical implementations, the dielectric constant of the substrate material, i.e., the relative permittivity $\varepsilon_r$, may be more than 3, e.g., in the range of 3 to 20, typically in the range of 5 to 8.

FIG. 1 shows a perspective view illustrating an antenna device 100 which is based on the illustrated concepts. In the illustrated example, the antenna device 100 includes a multi-layer circuit structure 110. The multi-layer circuit structure 110 includes multiple layers which are stacked in a vertical direction. The layers may for example each correspond to a structured metallization layer on an isolating substrate, e.g., based on a ceramic or a combination of a ceramic and glass. A cavity region 120 is formed in an edge region 115 of the multi-layer circuit structure 110. A vertical antenna patch 130 is arranged within the cavity region 120. The vertical antenna patch 130 extends in a vertical plane which is perpendicular to the layers of the multi-layer circuit structure 110 and is parallel to that one of the edges of the multi-layer circuit structure 110 which defines the edge region 115. The antenna patch 130 may be configured for transmission of radio signals polarized in the vertical direction, as illustrated by a solid arrow denoted by "V". Alternatively or in addition, the antenna patch 130 may be configured for transmission of radio signals polarized in the horizontal direction, as illustrated by a solid arrow denoted by "H".

In the illustrated antenna device 100, the cavity region 120 allows for reducing propagation of radio signals within the substrate material of the multi-layer circuit structure 110. By the cavity region 120. Accordingly, attenuation or distortion of radio signals can be avoided. In particular, the cavity region 120 may allow for significantly reducing propagation of surface waves along the edge of the multi-layer circuit structure 110.

As further illustrated, the antenna device 100 includes a radio front end circuitry chip 180 which is arranged in a cavity 170 formed in the multi-layer circuit structure 110. Accordingly, electric connections from the radio front end circuitry chip 180 to the antenna patch 130 can be efficiently formed by conductive strips on one or more of the layers of the multi-layer circuit structure. In particular, the electric connections may be formed with short lengths, so that signal losses at high frequencies can be limited. Further, one or more of the layers of the multi-layer circuit structure 110 may also be utilized for connecting the radio front end circuitry chip 180 to other circuitry, e.g., to power supply circuitry or digital signal processing circuitry.

Figure 2A:
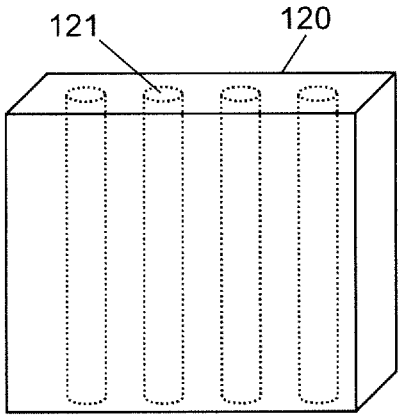
FIGS. 2A and 2B show further perspective views for schematically illustrating formation of a cavity region according to embodiments of the invention.
Figure 2B:
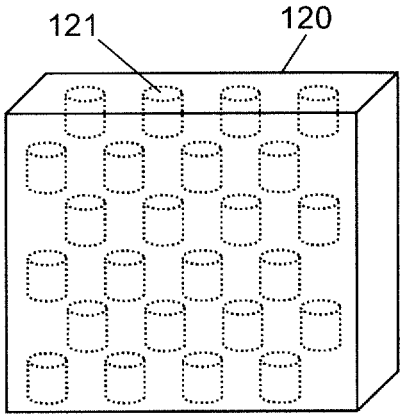

FIGS. 2A and 2B further illustrate formation of the cavity region 120. As illustrated, the cavity region 120 is formed by non-conductive vias 121. From the non-conductive vias 121, the substrate material of the multi-layer circuit structure 110 is removed. By removing the substrate material from the non-conductive vias 121, the overall density of the substrate material is reduced in the cavity region 120, resulting in a lower effective dielectric constant. The remaining substrate material in the cavity region 120 forms a mesh grid which acts as support for the antenna patch 130. Further, the remaining substrate material in the cavity region 120 may also act as support for other structures as further explained below.

The non-conductive vias 121 may be left open and thus be filled with air or a similar ambient medium, thereby obtaining a low dielectric constant in the non-conductive vias 121. However, one or more of the non-conductive vias 121 could also be filled with another dielectric material which has a lower dielectric constant than the substrate material of the multi-layer circuit structure 110. For example, if the substrate material is a ceramic material, the dielectric material for filling the non-conductive vias 121 could be a resin. Filling the non-conductive vias 121 with a solid dielectric material may allow for improving mechanical stability of the multi-layer circuit structure 110 in the cavity region 120.

As shown by the examples of FIGS. 2A and 2B, different geometrical configurations may be used for arranging the non-conductive vias 121. In the example of FIG. 2A, the non-conductive vias 121 are arranged according to a stripe grid. This configuration results in that the remaining substrate material forms a mesh grid which also corresponds to a stripe grid. Within the remaining substrate material, the non-conductive vias 121 thus form a one-dimensional lattice of voids or regions of reduced dielectric constant. In the example of FIG. 2B, the non-conductive vias 121 are arranged according to a checkerboard-like pattern. Within the remaining substrate material, the non-conductive vias 121 thus form a two-dimensional lattice of voids or regions of reduced dielectric constant.

It is noted that the geometric arrangements of the non-conductive vias 121 as illustrated in FIGS. 2A and 2B are merely exemplary, and that various other configurations possible as well. For example, two or more of the configurations as illustrated in FIGS. 2A and 2B could be stacked to obtain various three-dimensional arrangements of the non-conductive vias 121. Further, also irregular arrangements of the non-conductive vias 121 could be utilized.

Figure 3:
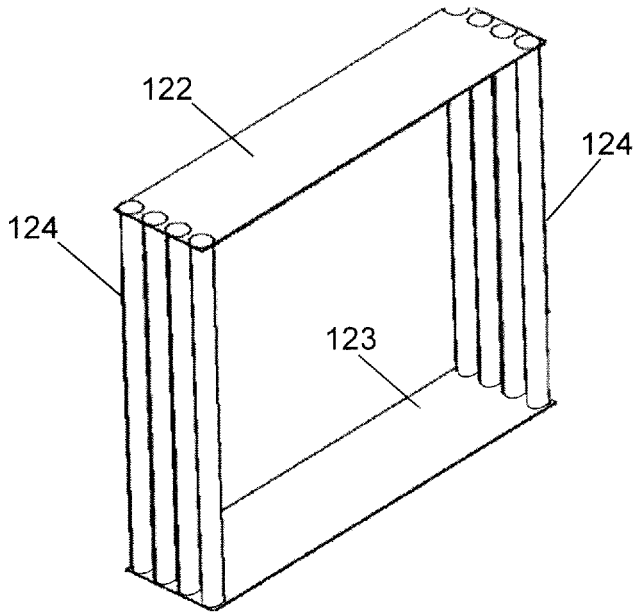
FIG. 3 shows a further perspective view for schematically illustrating conductive edges a cavity region according to an embodiment of the invention.

In some implementation, conductive structures may be provided on the edges of the cavity region 120. These conductive structures may act as a conductive shielding. This may help to further improve transmission characteristics by for example reducing propagation of surface waves from the antenna patch 130. FIG. 3 illustrates an example of how such conductive structures may be formed on the edges of the cavity region 120.

In the example of FIG. 3, a first conductive strip 122 is formed on a first (upper) horizontal edge of the cavity region 120. A second conductive strip 123 is formed on a second (lower) horizontal edge of the cavity region 120. On the vertical edges of the cavity region 120, the first conductive strip 122 and the second conductive strip 123 are connected to each other by conductive vias 124. As a result, a conductive structure having a geometry of a rectangular frame is formed along the outer edges of the cavity region 120.

It is noted that the configuration of the conductive structures on the edge of the cavity region 120 as illustrated in FIG. 3 is merely exemplary, and that other geometric configurations are possible as well. For example, conductive strips and conductive wires could also be arranged to approximate a curved, e.g., circular or elliptic, geometry of the cavity region 120.

Figure 4:
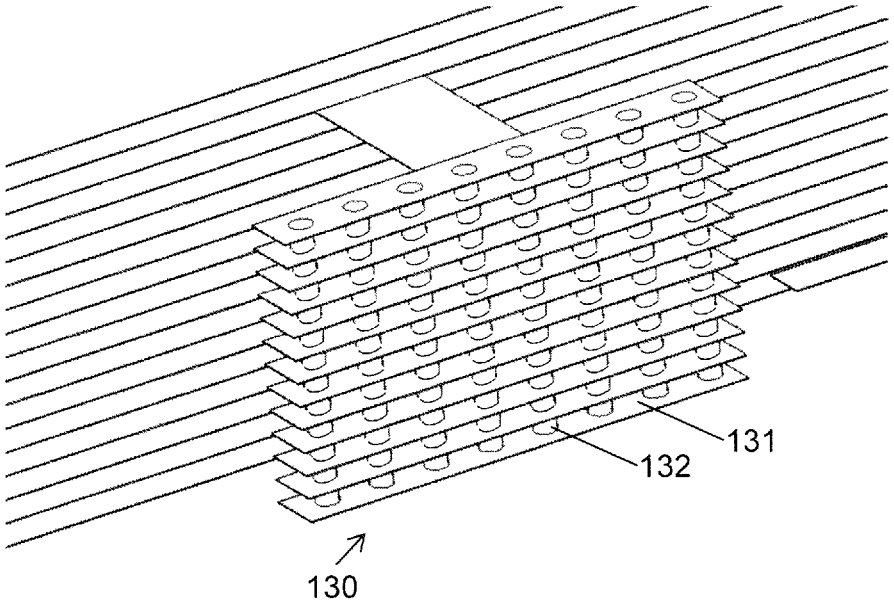
FIG. 4 shows a further perspective view for schematically illustrating a vertical antenna patch according to an embodiment of the invention.

FIG. 4 further illustrates configuration of the vertical antenna patch 130. Here, it is noted that for the sake of a better overview FIG. 4 focusses on conductive structures and does not show the non-conductive parts in the edge region 115 of the multi-layer circuit structure 110.

As can be seen, the vertical antenna patch 130 extends in a plane which is perpendicular to the layers of the multi-layer circuit structure 110 and extends along the edge of the of the multi-layer circuit structure 110. The vertical antenna patch 130 is formed of multiple conductive strips 131 on different layers of the multi-layer circuit structure 110. The conductive strips 131 are stacked above each other in the vertical direction, thereby forming a three-dimensional superstructure. The conductive strips 131 of the different layers are connected by conductive vias 132, e.g., metalized via holes. As illustrated, the conductive strips 131 and the conductive vias of the vertical antenna patch 130 are arranged in a mesh pattern and form a substantially rectangular conductive structure extending the plane perpendicular to the layers of the multi-layer circuit structure 110 and in parallel to the edge of the multi-layer circuit structure 110. The grid spacing of the mesh pattern is selected to be sufficiently small so that, at the intended wavelength of the radio signals to be transmitted by the vertical antenna patch 130, differences as compared to a uniform conductive structure are negligible. Typically, this can be achieved by a grid spacing of less than a quarter of the vertical and/or horizontal size of the vertical antenna patch 130. It is noted that various kinds of grid structures may be utilized, e.g., based on an irregular spacing of the conductive strips 131 and regular spacing of the vias 132, based on regular spacings both in the horizontal direction and vertical direction, or based on irregular spacings both in the horizontal direction and vertical direction. It is noted that also vias 132 which are non-aligned in the vertical direction could be utilized in the grid structure. Further, it is noted that various numbers of the conductive strips 131 and/or vias 132 may be used.

As mentioned above, the vertical antenna patch 130 may be configured for transmission of radio signals with a vertical polarization or for transmission of radio signals with a horizontal polarization direction. In the case of the horizontal polarization direction, the wavelength of the radio signals which can be transmitted by the vertical antenna patch 130 is determined by an effective horizontal dimension of the vertical antenna patch 130. For example, the horizontal width of the vertical antenna patch 130 (measured along the edge of one of the layers of the multi-layer circuit structure 110) may be used as the effective dimension L to determine the wavelength $\lambda$ of radio signals for which the vertical antenna patch 130 is resonant. In the case of the vertical polarization direction, the wavelength of the radio signals which can be transmitted by the vertical antenna patch 130 is determined by an effective vertical dimension of the vertical antenna patch 130. For example, the vertical width of the antenna patch 130 (measured perpendicular to the layers of the multi-layer circuit structure 110) may be used as the effective dimension L to determine the wavelength $\lambda$ of radio signals for which the vertical antenna patch 130 is resonant.

Figure 5:
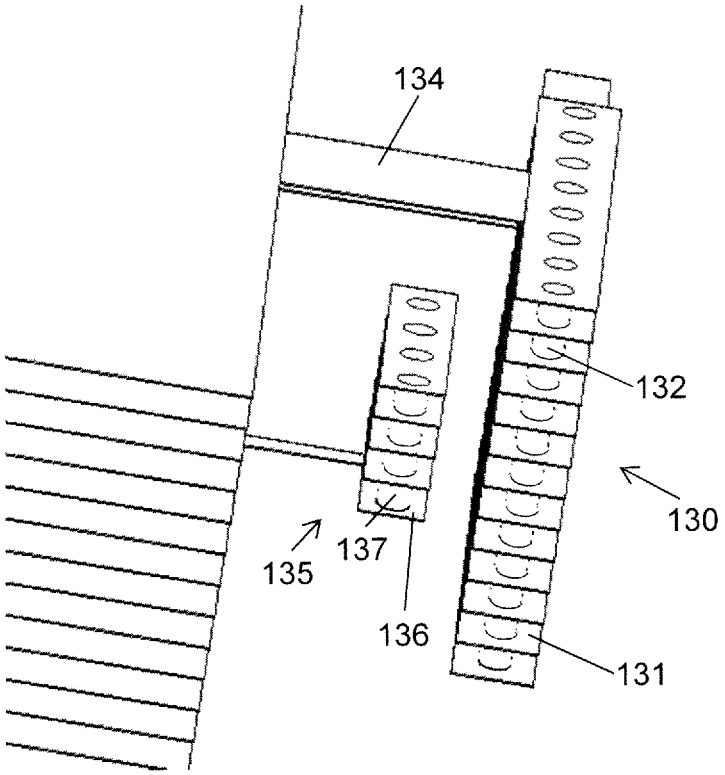
FIG. 5 shows a further perspective view for schematically illustrating an antenna patch and capacitive feeding patch according to an embodiment of the invention.

FIG. 5 further illustrates an exemplary configuration which may be used for feeding of the vertical antenna patch 130. In the example of FIG. 5, it is assumed that capacitive feeding of the vertical antenna patch 130 is used. However, it is to be noted that other ways of feeding the vertical antenna patch 130 could be utilized as well, e.g., conductive feeding and/or a combination of capacitive feeding and conductive feeding. Similar to FIG. 4, FIG. 5 focusses on conductive structures and does not show the non-conductive structures in the edge region 115 of the multi-layer circuit structure 110.

As can be seen, a feeding patch 135 is provided in a plane offset from the vertical antenna patch 130 towards the canter of the multi-layer circuit structure 110. Like the vertical antenna patch 130, also the feeding patch 135 is located in the above-mentioned cavity region 120. The feeding patch 135 is configured for capacitive feeding of the vertical antenna patch 130 and extends in parallel to the vertical antenna patch 130. In the illustrated example, the feeding patch 135 has a smaller size than the vertical antenna patch 130.

Similar to the vertical antenna patch 130, the feeding patch 135 is formed of multiple conductive strips 136 on different layers of the multi-layer circuit structure 110. The conductive strips 136 are stacked above each other in the vertical direction, thereby forming a three-dimensional superstructure. The conductive strips 136 of the different layers of the multi-layer circuit structure 110 are connected by conductive vias 137, e.g., metalized via holes. As illustrated, the conductive strips 136 and the conductive vias of the feeding patch 135 are arranged in a mesh pattern and form a substantially rectangular conductive structure extending the plane perpendicular to the layers of the multi-layer circuit structure 110 and in parallel to the edge of the multi-layer circuit structure 110. The grid spacing of the mesh pattern is selected to be sufficiently small so that, at the intended wavelength of the radio signals to be transmitted by the vertical antenna patch 130, differences as compared to a uniform conductive structure are negligible. Accordingly, the feeding patch 135 may be formed with a similar or the same grid spacing as the vertical antenna patch 130. Similar to the vertical antenna patch 130, the feeding patch 135 may have a regular grid structure or an irregular grid structure.

As further illustrated in FIG. 5, the device 100 may include a grounding patch 134 which electrically connects the vertical antenna patch 130 to a groundplane. The groundplane could be formed by a conductive region on one of the layers of the multi-layer circuit structure 110. The grounding patch 134 may be formed of a conductive strip formed on one of the layers of the multi-layer circuit structure 110. As illustrated in FIG. 5, the grounding patch 134 may be offset from the feeding patch 135 in the vertical direction. In this configuration, the vertical antenna patch 130 could be used for transmission of radio signals polarized in the vertical direction. By offsetting the grounding patch 134 in the horizontal direction from the feeding patch 135, the vertical antenna patch 130 could be configured for transmission of radio signals polarized in the horizontal direction.

Figure 6:
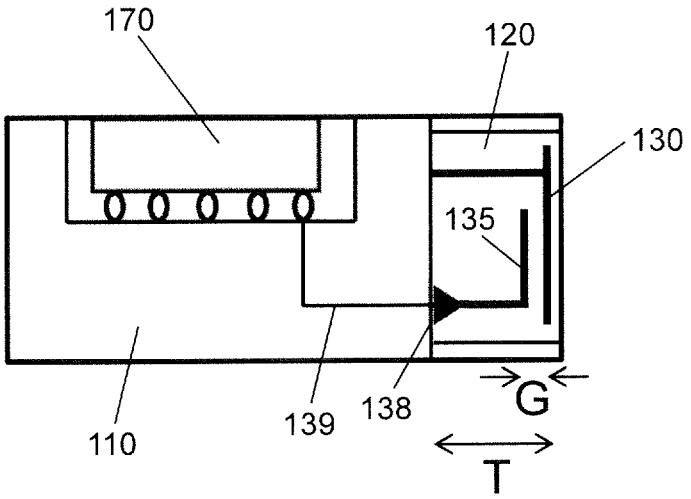
FIG. 6 shows a schematic sectional view of an antenna device according to an embodiment of the invention.

FIG. 6 shows a schematic sectional view for illustrating configuration of the antenna device 100. As illustrated, the vertical antenna patch 130 and the feeding patch 135 are arranged in the cavity region 120. As can be seen, the feeding patch 135 is connected to a feeding point 138. From the feeding point 138, an electrical connection 139 to the radio front end circuitry chip 180 is formed in the multi-layer circuit structure 110. The depth of the cavity region 120 measured from the edge of the multi-layer circuit structure 110 is denoted by T. The feeding patch 135 is spaced by a distance G from the vertical antenna patch 130. The depth T of the cavity region 120 may be in the range of 0.5 mm to 2 mm, typically about 1 mm. The distance G and the size of the feeding patch 135 may be set with the aim of optimizing capacitive coupling to the vertical antenna patch 130. Simulations have shown that a small sized feeding patch 135, e.g., having a quarter or less of the size of the vertical antenna patch 130, allows for achieving a good bandwidth a compact overall size of the vertical patch antenna 130, and an almost uniform omnidirectional transmission characteristic.

Further, the depth T of the cavity region 120, the size of the vertical antenna patch 130, and the distance G, and the length L may be set according to the nominal wavelength of radio signals to be transmitted or received via the vertical antenna patch 130. When assuming that the vertical antenna patch 130 is used in a quarter wave patch antenna configuration, the vertical or horizontal size of the vertical antenna patch 130 correspond to a quarter of the nominal wavelength, and the distance G may be less than a quarter of the nominal wavelength. Also the depth T of the cavity region may then be in the range of a quarter of the nominal wavelength or less. If the vertical antenna patch 130 is used in a half wave patch antenna configuration, the grounding patch 134 may be omitted and the vertical or horizontal size of the vertical antenna patch 130 may correspond to half of the nominal wavelength. In the direction which does not correspond to the polarization direction of the radio signals to be transmitted on received via the vertical antenna patch 130, a slightly smaller size of the vertical antenna patch 130 may be used.

Figure 7:
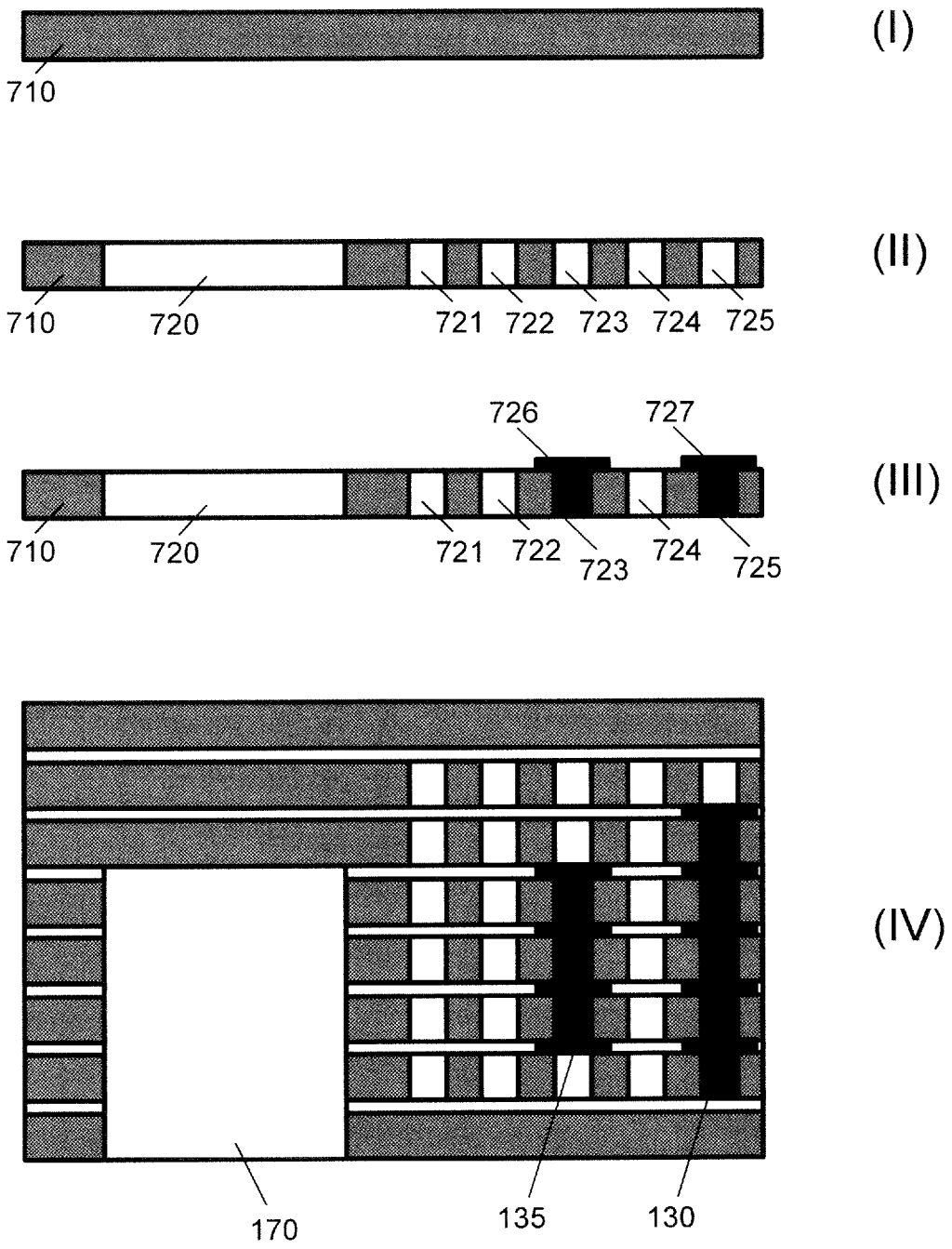
FIG. 7 schematically illustrates fabrication of an antenna device according to an embodiment of the invention.

FIG. 7 schematically illustrates processes which may be used for formation of the cavity region 120 the vertical antenna patch 130, and the feeding patch 135 in the multi-layer circuit structure 110.

In a first stage, denoted by (I), multiple sheets 710 of the substrate material are provided. Each of these sheets 710 corresponds to an individual layer of the multi-layer circuit structure 110 to be formed. The individual sheets 710 may be cut to a shape which is determined in accordance with the outer geometry of the multi-layer circuit structure 110 to be formed. Here, it is noted that the shape of the individual sheets 710 may differ from layer to layer.

In a second stage, denoted by (II) via holes 720, 721, 722, 723, 724, 725 are formed in the individual sheets 710. As illustrated, the holes 720, 721, 722, 723, 724, 725 may be formed different sizes. The holes may be formed by punching, drilling, machining, etching or a combination of such techniques. In the illustrated example, the holes 721, 722, 723, 724, 725 have the purpose of forming the above-mentioned non-conductive vias 121 and the above-mentioned conductive vias 124, 132, 137. The hole 720 has the purpose of forming the above-mentioned cavity 170 for holding the radio front end circuitry chip 180. Here, it is noted that the shape, number, and/or positions of holes may differ from layer to layer.

In a third stage, denoted by (III), some of the holes 720, 721, 722, 723, 724, 725 are filled with conductive material, such as metal. In the illustrated example, these are the holes 723 and 725. Other holes, in the illustrated example the holes 720, 721, 722, and 724, are left empty or filled with a solid dielectric material having a lower dielectric constant than the substrate material of the sheets 710. Further, conductive strips 726, 727 are formed on one or both sides of the individual sheets, e.g., by depositing a metallic layer. Here, it is noted that the filling of holes may differ from layer to layer and/or the shape, number, and/or positions of conductive strips may differ from layer to layer.

In a fourth stage, denoted by (IV), the individual layers 710 are aligned and stacked, and the multi-layer circuit structure 110 is formed by laminating the individual layers 710 on to each other. In the illustrated example, this illumination is assumed to be achieved by co-firing at low temperature. However, other lamination techniques could be used in addition or as an alternative.

Figure 8:
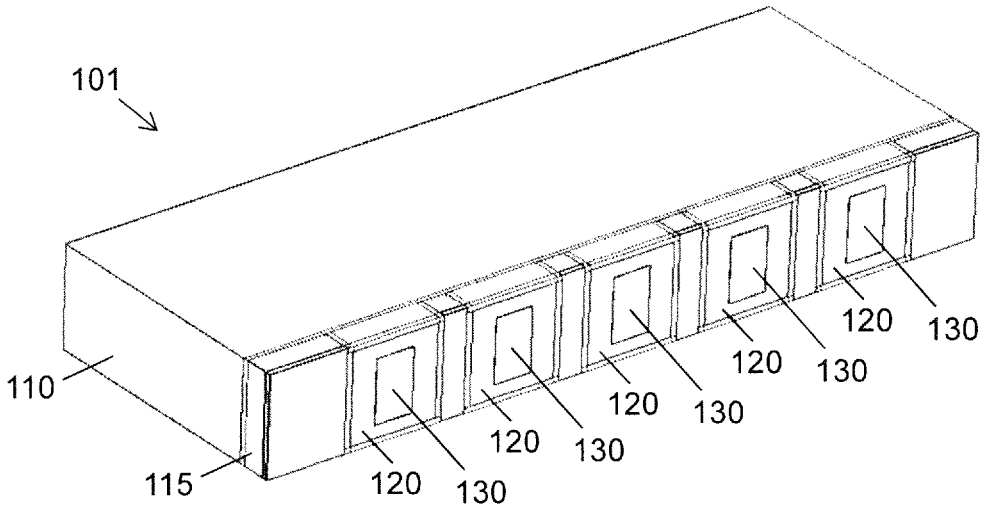
FIG. 8 shows a perspective view schematically illustrating an antenna device according to an embodiment of the invention, which is provided with multiple vertical antenna patches arranged in multiple cavity regions.

FIG. 8 shows a perspective view illustrating a further antenna device 101 which is based on the illustrated concepts. The antenna device 101 is generally similar to the above-described antenna device 100. However, as compared to the antenna device 100, the antenna device 101 includes multiple cavity regions 120 and multiple vertical antenna patches 130, which are each arranged in a corresponding one of the multiple cavity regions 120. The cavity regions 120 and the antenna patches 130 may each be configured and fabricated as explained in connection with FIGS. 1 to 7.

It is noted that in a configuration with multiple vertical antenna patches 130 as illustrated in FIG. 8, all vertical antenna patches 130 could be configured for transmission of radio signals polarized in the vertical direction, or all vertical antenna patches 130 could be configured for transmission of radio signals polarized in the horizontal direction. However, mixed configurations are possible as well, in which one or more of the antenna patches 130 are configured for transmission of radio signals polarized in the vertical direction while one or more others of the antenna patches 130 are configured for transmission of radio signals polarized in the horizontal direction. Moreover, it is noted that in some implementations it would also be possible to include multiple vertical antenna patches 130 into the same cavity region 120.

Figure 9:
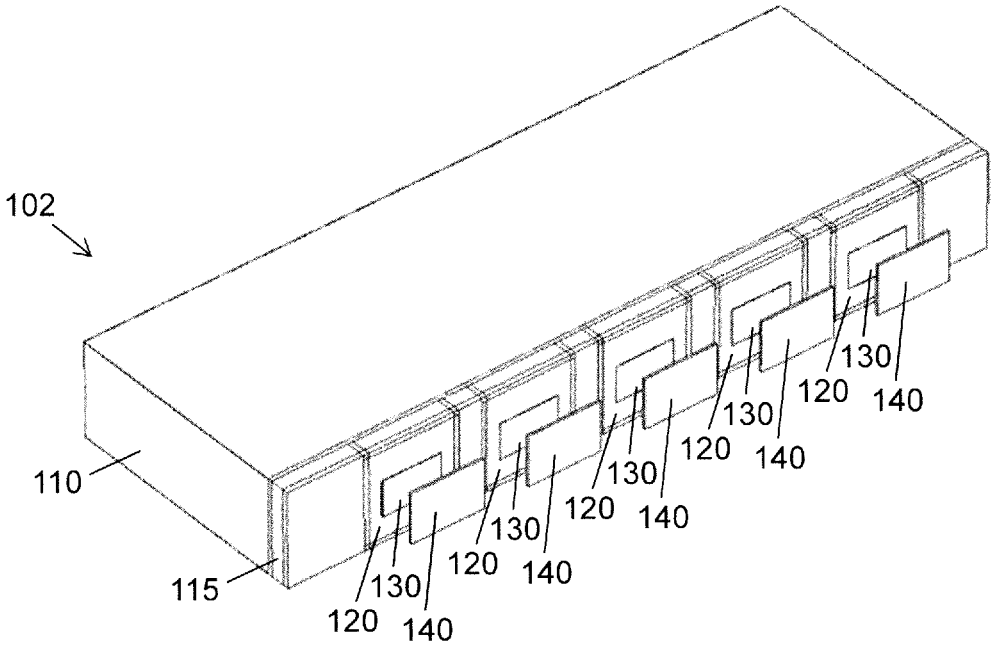
FIG. 9 shows a perspective view schematically illustrating an antenna device according to a further embodiment of the invention, which further includes electrically floating patches.

FIG. 9 shows a perspective view illustrating a further antenna device 102 which is based on the illustrated concepts. The antenna device 102 is generally similar to the above-described antenna device 101. That is to say, the antenna device 102 includes the multiple vertical antenna patches 130 which are arranged in the cavity regions 120.

As illustrated, the antenna device 102 differs from the antenna device 101 in that it further includes electrically floating patches 140. For each of the vertical antenna patches 130, a corresponding floating patch 140 is provided. The floating patch 140 is coupled only capacitively to the corresponding vertical antenna patch 130 and does not have any conductive coupling to ground or some other fixed potential.

Figure 10:
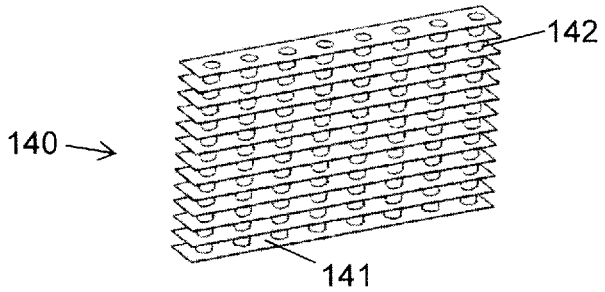
FIG. 10 shows a perspective view schematically illustrating an electrically floating patch according to an embodiment of the invention.

As illustrated, the floating patch 140 is arranged in a plane which is offset from the corresponding vertical antenna patch 130 in a direction towards a periphery of the multi-layer circuit structure 110. As illustrated in FIG. 10, the floating patch 140 can be formed in a similar manner as the vertical antenna patch 130 and the feeding patch 135, i.e., of conductive strips 141 on different layers of the multi-layer circuit structure 110, which are connected by conductive vias 142, e.g., metalized via holes. When looking onto the edge of the multi-layer circuit structure 110, the floating patch 140 is located in front of the vertical antenna patch 130 and thus can be used to tune radiation characteristics of the vertical antenna patch 130. Specifically, the floating patch 140 he be used for enhancing the useful bandwidth of the radio signals transmitted via the vertical antenna patch 130.

Figure 11:
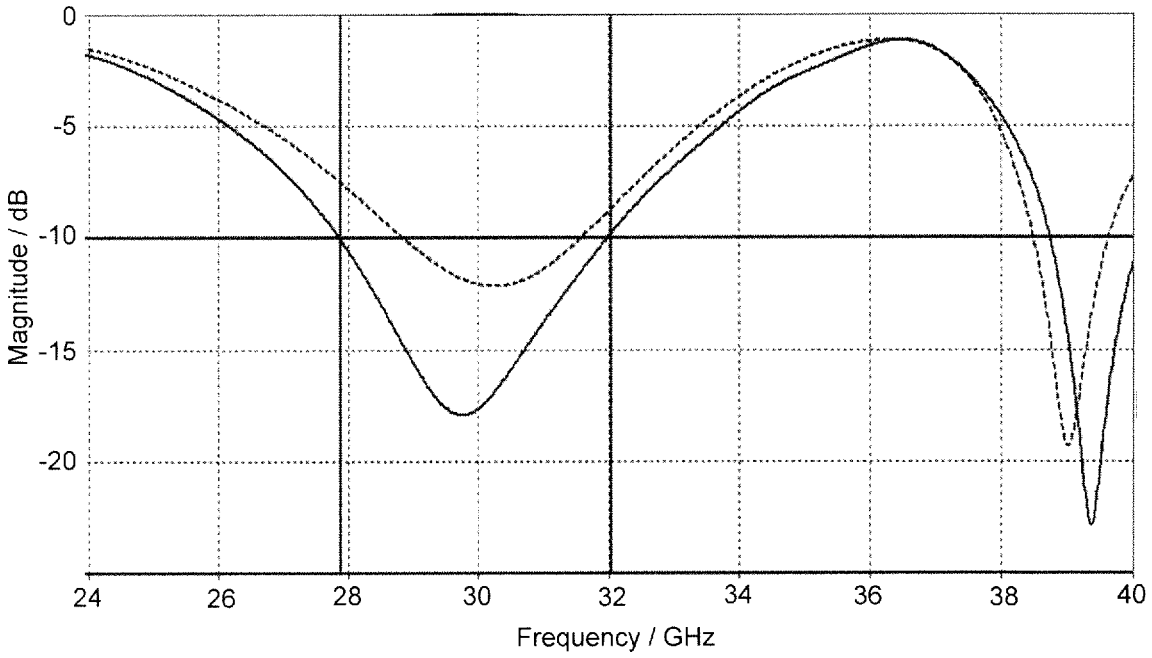
FIG. 11 shows a diagram for illustrating characteristics of antenna devices according to embodiments of the invention.

This enhancement of the useful bandwidth can for example be seen from simulation results as shown in FIG. 11. In FIG. 11, magnitude of signals transmitted using an antenna configuration with the floating patch 140 is illustrated by a solid line, whereas the magnitude of signals transmitted using an antenna configuration without the floating patch 140 is illustrated by a dashed line. As can be seen, in each case a resonant frequency at about 30 GHz is obtained. In the case of the antenna configuration with the floating patch 140, the useful bandwidth (defined as a range where the magnitude exceeds −10 dB) is about 2 GHz. In the case of the antenna configuration without the floating patch 140, the useful bandwidth is about 4 GHz.

Figure 12:
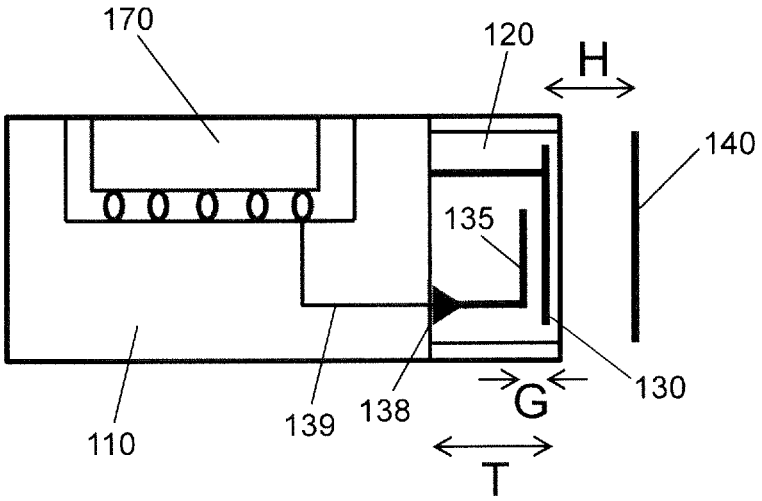
FIG. 12 shows a schematic sectional view of an antenna device according to an embodiment of the invention, which is provided with an electrically floating patch.

FIG. 12 shows a schematic sectional view for illustrating configuration of the antenna device 102. As illustrated, the vertical antenna patch 130 and the feeding patch 135 are arranged in the cavity region 120. The floating patch is offset from the vertical antenna patch 130, on the opposite side of the feeding patch 135, i.e., towards the periphery of the multi-layer circuit structure 110. Similar to the antenna device 100, the feeding patch 135 is connected to a feeding point 138, and from the feeding point 138, an electrical connection 139 to the radio front end circuitry chip 180 is formed in the multi-layer circuit structure 110. The depth of the cavity region 120 measured from the edge of the multi-layer circuit structure 110 is denoted by T. The distance of the floating patch 140 to the vertical antenna patch 130 is denoted by H. The feeding patch 135 is spaced by a distance G from the vertical antenna patch 130. Dimensioning of the size of the vertical antenna patch, of the depth T, and of the distance G may be as explained in connection with FIG. 6.

The distance H of the floating patch 140 to the vertical antenna patch 130 may be in the range from 1 mm to 4 mm. Simulations have shown that in this range the distance H there is no significant dependence of the resulting resonant frequency on the value of the distance H. Accordingly, stable impedance matching can be achieved even in implementations where the distance H is less precisely controlled. Examples of such implementations include configurations where the floating patch is not integrated within the multi-layer circuit structure 110, but is rather provided on a separate element, such as on a casing element like a part of a case or housing which accommodates the antenna device 102. Examples of such configurations are illustrated in FIGS. 13 and 14.

Figure 13:
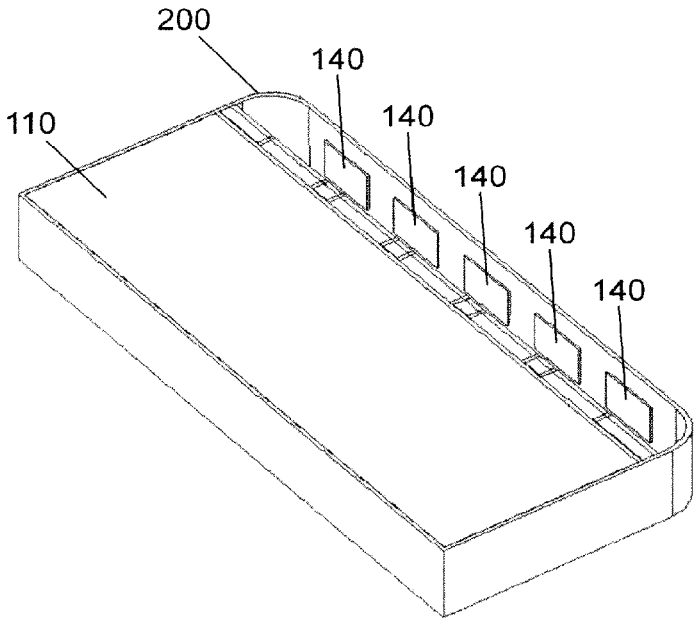
FIG. 13 illustrates an arrangement of electrically floating patches according to an embodiment of the invention.

In the example of FIG. 13, the multi-layer circuit structure 110 is enclosed in a frame 200. On the side of the multi-layer circuit structure 110 where the vertical antenna patches 130 are formed, the frame 200 is spaced apart from the edge of the multi-layer circuit structure 110. On the other sides of multi-layer circuit structure 110, the frame 200 may closely fit to the edges of multi-layer circuit structure 110. As can be seen, in this case the floating patches 140 may be provided on that part of the frame 200 which faces the vertical antenna patches 130. For example, the floating patches 140 could be provided as printed or otherwise deposited metal layers. An assembly including the multi-layer circuit structure 110 and the frame 200 with the floating patches 140 may form as a package for incorporation into other devices, e.g., into a communication device, such as a mobile phone, smartphone, tablet computer, or the like.

It is noted that while in the example of FIG. 13 the floating patch 140 is arranged on the inner side of the frame 200, i.e., the side facing towards the vertical antenna patches 130, other arrangements are possible as well. For example, the floating patch 140 could be provided on the outer side of the frame 200, i.e., the side which faces away from the vertical antenna patches 130. Further, the floating patch 140 could be provided on both the inner side and the outer side of the frame 200.

Figure 14:
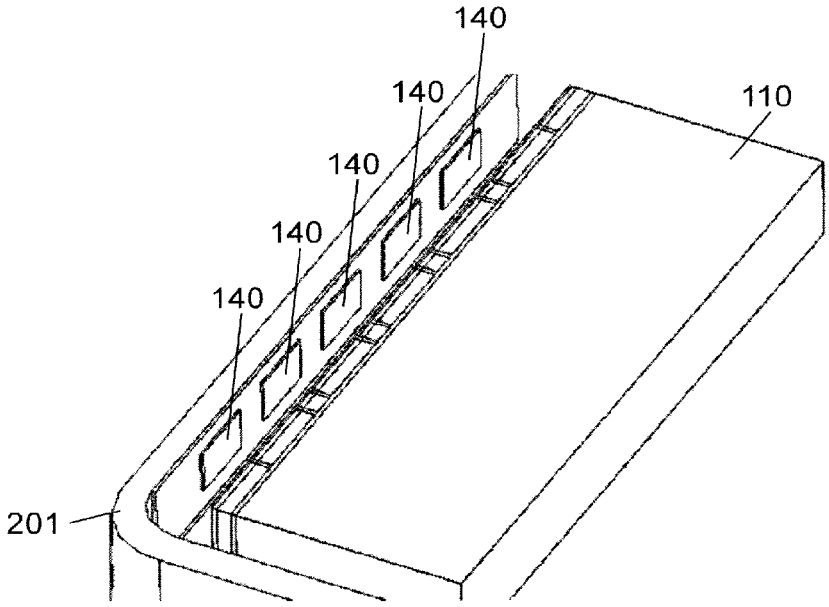
FIG. 14 illustrates a further arrangement of electrically floating patches according to an embodiment of the invention.

In the example of FIG. 14, the multi-layer circuit structure 110 is assumed to be incorporated into a communication device, such as a mobile phone, smartphone, tablet computer, or the like. As illustrated, the multi-layer circuit structure is arranged close to a housing 201 of the communication device, with a certain distance between the housing 201 and the edge of the multi-layer circuit structure 110 where the vertical antenna patches 130 are formed. As can be seen, in this case the floating patches 140 may be provided on that part of the housing 201 which faces the vertical antenna patches 130. For example, the floating patches 140 could be provided as printed or otherwise deposited metal layers.

It is noted that while in the example of FIG. 14 the floating patch 140 is arranged on the inner side of the housing 201, i.e., the side facing towards the vertical antenna patches 130, other arrangements are possible as well. For example, the floating patch 140 could be provided on the outer side of the housing 201, i.e., the side which faces away from the vertical antenna patches 130. Further, the floating patch 140 could be provided on both the inner side and the outer side of the housing 201.

In scenarios where the above-described antenna devices 100, 101, 102 are incorporated into a case or housing, this housing would typically be formed at least in part of a non-conductive and thus dielectric material. In this way, it can be avoided that the case or housing acts as a shielding with respect to the radio signals transmitted via the vertical antenna patch 130. However, the use of a dielectric material in the case or housing may cause distortion and/or refraction of the radio signals when passing through the dielectric material of the case or housing. This effect increases with increasing frequency of the radio signals and maybe significant in the case of radio signals in the in the millimeter wavelength range, corresponding to frequencies in the range of about 10 GHz to about 100 GHz. In the following, implementations will be described which allow for addressing such effects on the radio signals when passing through a part of a case or housing which is formed of a dielectric material. This is achieved by further providing the above-described antenna devices 100, 101, 102 with a dielectric patch in which the dielectric constant varies according to a certain variation pattern.

Figure 15:
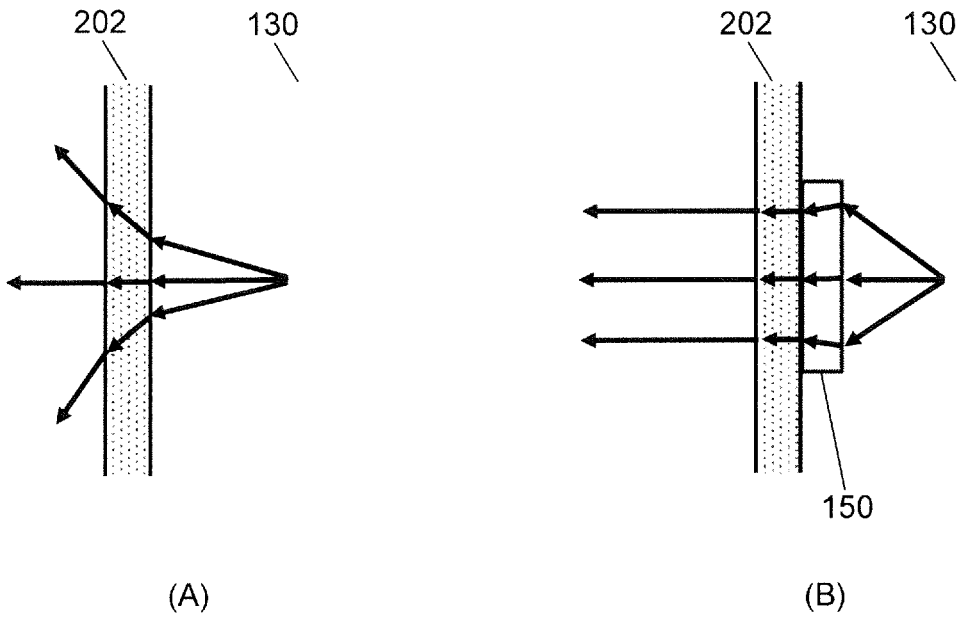
FIG. 15 schematically illustrates effects of a dielectric patch according to an embodiment of the invention.

FIGS. 15(A) and 15(B) illustrate the effects of such dielectric patch. FIG. 15(A) schematically illustrates the propagation of radio signals from the vertical antenna patch 130 through a casing element 202 formed of a dielectric material, such as a part of a case or housing. As illustrated, the radio signals are distorted when passing through the casing element 202, causing divergence of the radio signals after having passed through the casing element 202. This kind of divergences is typically not desirable since it may result in reduced signal quality. As compared to that, FIG. 15(B) illustrates a scenario where a dielectric patch 150 is provided on the casing element 202, so that the radio signals transmitted from the antenna patch 130 pass those through the dielectric patch 150 and the casing element 202. As illustrated, the dielectric patch 150 is configured to act like a converging lens on the radio signals, thereby compensating the divergences caused by the casing element 202. This configuration of the dielectric patch 150 is achieved by the variation pattern of the dielectric constant configured in the dielectric patch 150. For example, the dielectric patch 150 could be configured to act like a converging lens by defining the variation pattern in such a way that the dielectric constant increases towards the center of the dielectric patch 150.

Figure 16:
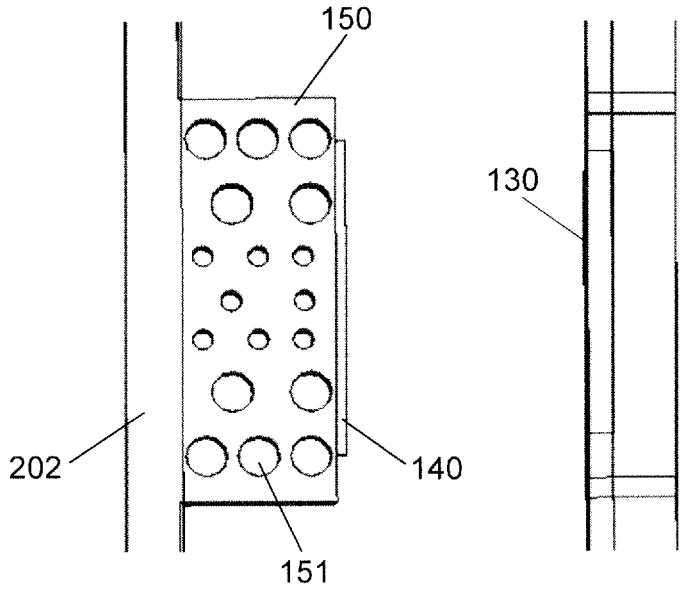
FIG. 16 schematically illustrates configuration and arrangement of a dielectric patch according to an embodiment of the invention.

FIG. 16 illustrates an example of how the dielectric patch 150 may be configured with a variation pattern of the dielectric constant that causes the dielectric patch 150 to act as a converging lens for the radio signals. In the example of FIG. 16, this is achieved by providing non-conductive vias 151 in the dielectric patch 150 and using the size and/or density of the non-conductive wires 151 to tune the local effective value of the dielectric constant. In the example of FIG. 16, the size of the non-conductive vias 151 decreases from the edge towards the center of the dielectric patch 150 (along a direction perpendicular to a propagation path of the radio signals). Further, the density of the non-conductive vias 151 decreases from the edge towards the center of the dielectric patch 150 (along a direction perpendicular to a propagation path of the radio signals).

Although FIG. 16 illustrates the variation pattern in only one plane, it is to be understood that the non-conductive vias 151 may be arranged according to various three-dimensional patterns and geometries so as to achieve a desired lens characteristic. Such lens characteristics may include characteristics of a cylinder lens, but also characteristics of spherical or parabolic lenses.

As further illustrated in FIG. 16, the dielectric patch 150 may also be combined with the floating patch 140 as explained in connection with FIGS. 9 to 14, e.g., by providing the dielectric patch 150 and the floating patch 140 as a sandwich structure on the casing element 202. Here, it is noted that the illustrated order of arranging the floating patch 140, the dielectric patch 150, and the casing element 202 is merely exemplary, and that these elements could be rearranged in various ways. For example, the floating patch 140 could be provided on the side of the casing element 202 which faces away from the vertical antenna patch 130, while the dielectric patch 150 is provided on the side of the casing element 202 which faces towards the vertical antenna patch 130. Further, both the floating patch 140 and the dielectric patch 150 could be provided on the side of the casing element 202 which faces away from the vertical antenna patch 130. Still further, the floating patch 140 could be sandwiched between the dielectric patch 150 and the casing element 202.

Various configurations may be utilized for providing the antenna device 101, 101, or 102 with the above-described dielectric patch 150 or dielectric patches 150. Examples of such configurations will now be further described with reference to FIGS. 17 to 19.

Figure 17:
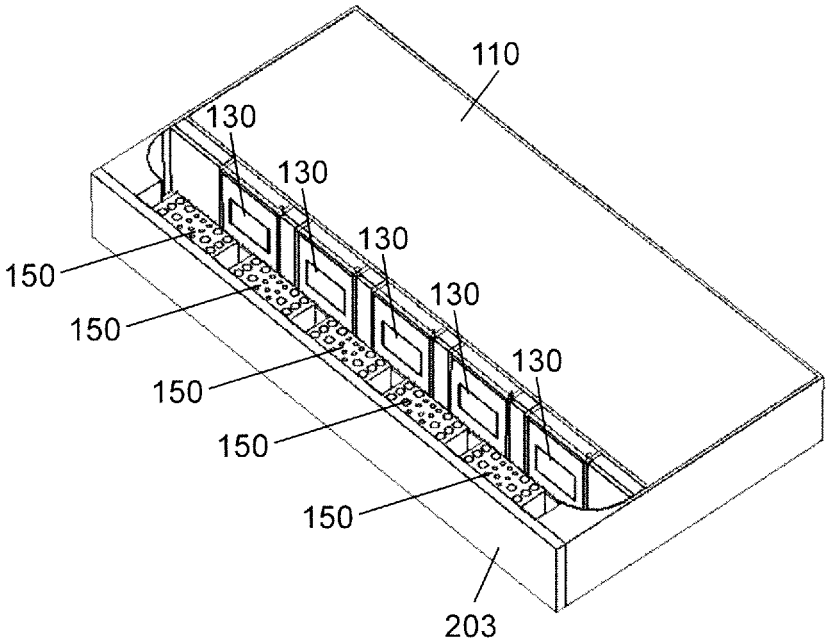
FIG. 17 schematically illustrates an arrangement of dielectric patches according to an embodiment of the invention.

In the example of FIG. 17, the multi-layer circuit structure 110 is enclosed in a frame 203. On the side of the multi-layer circuit structure 110 where the vertical antenna patches 130 are formed, the frame 203 is spaced apart from the edge of the multi-layer circuit structure 110. On the other sides of multi-layer circuit structure 110, the frame 203 may closely fit to the edges of multi-layer circuit structure 110. As can be seen, in this case the dielectric patches 150 may be attached to that part of the frame 203 which faces the vertical antenna patches 130. For example, the dielectric patches 150 could be glued to the inside of the frame 203. In the configuration FIG. 17, the dielectric patches 150 may be formed of a material which is different from a material of the frame 203. An assembly including the multi-layer circuit structure 110 and the frame 203 with the dielectric patches 150 may form as a package for incorporation into other devices, e.g., into a communication device, such as a mobile phone, smartphone, tablet computer, or the like.

Figure 18:
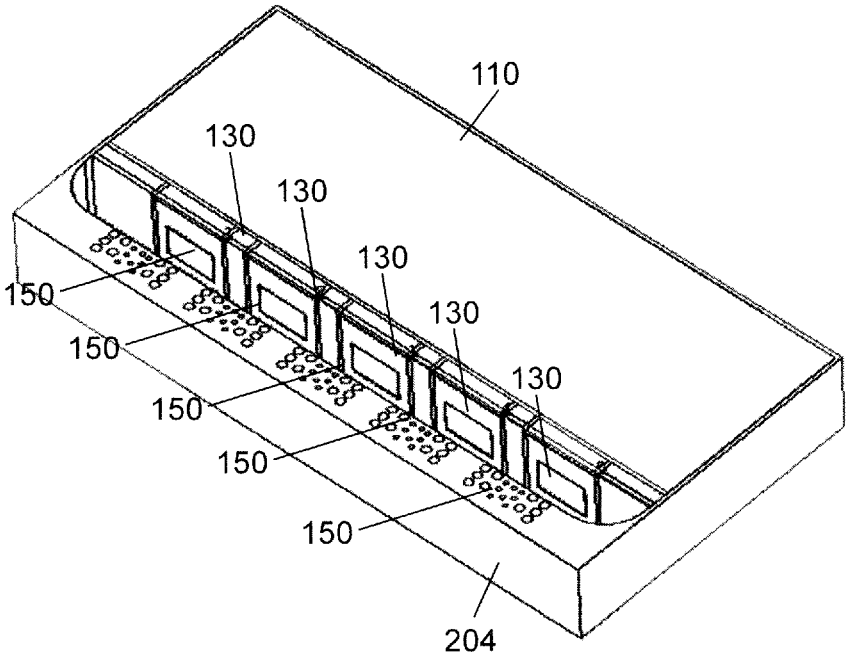
FIG. 18 schematically illustrates a further arrangement of dielectric patches according to an embodiment of the invention.

In the example of FIG. 18, the multi-layer circuit structure 110 is enclosed in a frame 204. On the side of the multi-layer circuit structure 110 where the vertical antenna patches 130 are formed, the frame 204 is spaced apart from the edge of the multi-layer circuit structure 110. On the other sides of multi-layer circuit structure 110, the frame 204 may closely fit to the edges of multi-layer circuit structure 110. In the configuration of FIG. 17, the dielectric patches 150 are formed within the material of that part of the frame 204 which faces the vertical antenna patches 130. For example, the dielectric patches 150 could be formed by drilling, punching and/or otherwise machining the nonconductive via holes 151 into the material of the frame 204. An assembly including the multi-layer circuit structure 110 and the frame 204 with the dielectric patches 150 may form as a package for incorporation into other devices, e.g., into a communication device, such as a mobile phone, smartphone, tablet computer, or the like.

Figure 19:
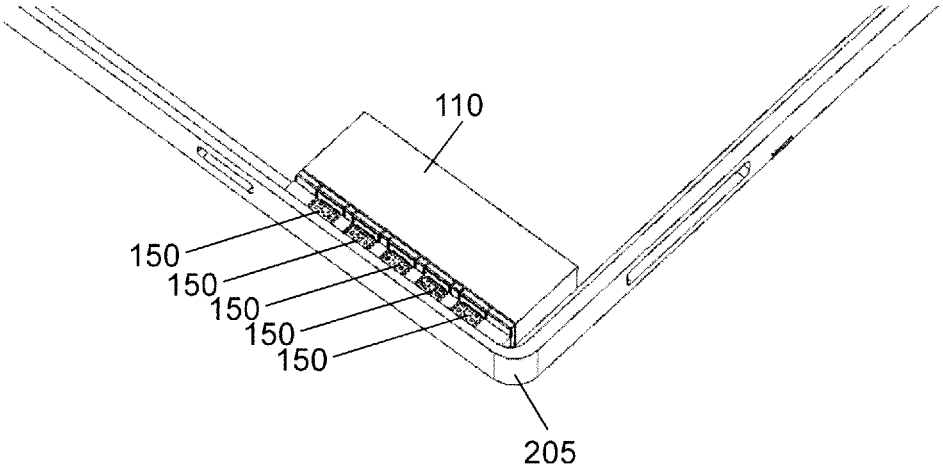
FIG. 19 schematically illustrates a further arrangement of dielectric patches according to an embodiment of the invention.

In the example of FIG. 19, the multi-layer circuit structure 110 is assumed to be incorporated into a communication device, such as a mobile phone, smartphone, tablet computer, or the like. As illustrated, the multi-layer circuit structure is arranged close to a housing 205 of the communication device. As can be seen, in this case the dielectric patches 150 may be provided within the material of that part of the housing 205 which faces the vertical antenna patches 130. For example, the dielectric patches 150 could be formed by drilling, punching and/or otherwise machining the nonconductive via holes 151 into the material of the frame 204.

Figure 20:
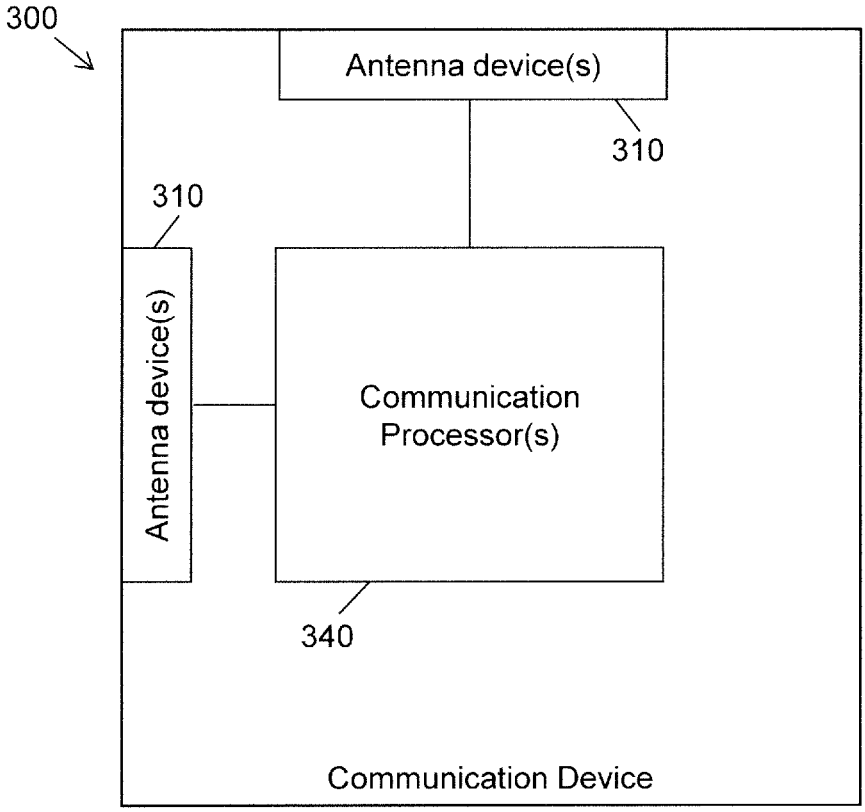
FIG. 20 shows a block diagram for schematically illustrating a communication device according to an embodiment of the invention.

FIG. 20 schematically illustrates a communication device 300 which is equipped with one or more antenna devices 310. These antenna devices 310 may correspond to the above-described type, e.g., to the antenna device 100, 101, or 102. Further, the communication device 300 may also include other kinds of antennas. The communication device may correspond to a small sized user device, e.g., a mobile phone, a smartphone, a tablet computer, or the like. However, it is to be understood that other kinds of communication devices could be used as well, e.g., vehicle based communication devices, wireless modems, or autonomous sensors.

As further illustrated, the communication device 300 also includes one or more communication processor(s) 340. The communication processor(s) 340 may generate or otherwise process communication signals for transmission via the antenna devices 310. For this purpose, the communication processor(s) 340 may perform various kinds of signal processing and data processing according to one or more communication protocols, e.g., in accordance with a 5G cellular radio technology.

It is to be understood that the concepts as explained above are susceptible to various modifications. For example, the concepts could be applied in connection with various kinds of radio technologies and communication devices, without limitation to a 5G technology. The illustrated antenna devices may be used for transmitting radio signals from a communication device and/or for receiving radio signals in a communication device. Further, it is to be understood that the illustrated antenna structures may be subjected to various modifications concerning antenna geometry, and various shapes of the antenna patch, feeding patch, floating patch, and/or dielectric patch could be utilized. For example, the illustrated rectangular shapes of the antenna patch, feeding patch, floating patch, or dielectric patch could be modified to more complex shapes, e.g., L-like shape, F-like shape, H-like shape. Further, also utilization of curved shapes, such as circular or elliptic would be possible. Further, it is noted that individual features of the antenna devices as described above may be combined in various ways. For example, the above-mentioned dielectric patches could also be utilized for antenna devices which do not include the above-mentioned cavity region.

The invention claimed is:

1. A device, comprising:

a multi-layer circuit structure having multiple layers stacked along a vertical direction;

at least one cavity region formed at an edge of the multi-layer circuit structure, the at least one cavity region being formed of multiple non-conductive vias from which a dielectric substrate material of the multi-layer circuit structure is removed; and at least one vertical antenna patch arranged in the at least one cavity region.

2. The device according to claim 1, wherein the cavity region comprises:

at least one first conductive strip formed in one or more of the multiple layers and defining a first horizontal edge of the cavity region;

at least one second conductive strip formed in one or more of the multiple layers and defining a second horizontal edge of the cavity region; and conductive vias extending between the at least one first conductive strip and the at least one second conductive strip and defining vertical outer edges of the cavity region.

3. The device according to claim 1, wherein the non-conductive vias of the cavity region are arranged to form a mesh grid of the substrate material in the cavity region.

4. The device according to claim 1, wherein the vertical antenna patch is formed of multiple conductive strips formed in one or more of the multiple layers, the conductive strips of the vertical antenna patch being electrically connected to each other by conductive vias extending between two or more of the conductive strips which are arranged on different layers of the multi-layer circuit structure.

5. The device according to claim 4, wherein the conductive strips and the conductive vias of the antenna patch are arranged to form a mesh pattern.

6. The device according to claim 1, wherein the non-conductive vias forming the cavity region are filled with a dielectric material having a lower dielectric constant than the substrate material of the multi-layer circuit structure.

7. The device according to claim 1, wherein the non-conductive vias forming the cavity region are filled with air.

8. The device according to claim 1, comprising:

at least one electrically floating patch capacitively coupled to the at least one antenna patch and arranged in a plane offset from the at least one antenna patch in a direction towards a periphery of the multi-layer circuit structure.

9. The device according to claim 8, wherein the electrically floating patch is formed of multiple conductive strips in one or more of the multiple layers, the conductive strips of the electrically floating patch being electrically connected to each other by conductive vias extending between two or more of the conductive strips of the electrically floating patch, which are arranged on different layers of the multi-layer circuit structure.

10. The device according to claim 8, wherein the electrically floating patch is formed by a vertical conductive strip formed on a casing element in which the multi-layer circuit structure is arranged.

11. The device according to claim 1, comprising:

a casing element in which the multi-layer circuit structure is arranged; and at least one dielectric patch arranged on the casing element in a plane facing the at least one antenna patch, the at least one dielectric patch being configured with a variation pattern of dielectric constant.

12. The device according to claim 11, wherein the at least one dielectric patch comprises non-conductive vias from which a dielectric substrate material of the dielectric patch is removed.

13. The device according to claim 12, wherein the variation pattern is configured by setting a density of non-conductive vias of the dielectric patch and/or by setting a size of the non-conductive vias of the dielectric patch.

14. The device according to claim 13, wherein the variation pattern defines an increase of dielectric constant towards a center of the dielectric patch.

15. The device according to claim 1, comprising:

at least one feeding patch arranged in the at least one cavity region and configured for capacitive feeding of the at least one antenna patch, the feeding patch being formed of multiple conductive strips in one or more of the multiple layers, the conductive strips of the feeding patch being electrically connected to each other by conductive vias extending between two or more of the conductive strips of the feeding patch, which are arranged on different layers of the multi-layer circuit structure.

16. The device according to claim 1, wherein the substrate material of the multi-layer circuit structure comprises a ceramic material.

17. The device according to claim 1, wherein the layers of the multi-layer circuit structure are assembled by low temperature co-firing.

18. The device according to claim 1, comprising:

radio front end circuitry arranged on the multi-layer circuit structure.

19. The device according to claim 18, wherein the multi-layer circuit structure comprises a cavity in which the radio front end circuitry is received.

20. A communication device, comprising:

at least one device according to claim 1; and at least one processor configured to process communication signals transmitted via the at least one antenna patch of the at least one device.

* * * * *